US005737841A

United States Patent [19]

McHenry et al.

[11] Patent Number: 5,737,841

[45] Date of Patent: Apr. 14, 1998

[54] POCKET KNIFE WITH LOCK

[76] Inventors: William J. McHenry, 265 Carolina Nooseneck Rd., Wyoming, R.I. 02898; Jason L. Williams, 780 Victory Highway, #45, West Greenwich, R.I. 02817

[21] Appl. No.: 679,122

[22] Filed: Jul. 12, 1996

[51] Int. Cl.[6] ..... B26B 1/04

[52] U.S. Cl. ..... 30/161; 30/160

[58] Field of Search ..... 30/160, 161, 331, 30/133; 7/118

[56] References Cited

U.S. PATENT DOCUMENTS

| | | |
|---|---|---|
| 1,189,005 | 6/1916 | Seely . |
| 3,868,774 | 3/1975 | Miori . |
| 4,240,201 | 12/1980 | Sawby et al. . |
| 4,274,200 | 6/1981 | Coder . |
| 4,451,982 | 6/1984 | Collins . |
| 4,502,221 | 3/1985 | Pittman . |
| 4,670,984 | 6/1987 | Rickard . |
| 4,837,932 | 6/1989 | Elsener . |
| 5,060,379 | 10/1991 | Neely . |
| 5,111,581 | 5/1992 | Collins ..... 30/161 |
| 5,425,175 | 6/1995 | Rogers . |
| 5,461,786 | 10/1995 | Miller . |

*Primary Examiner*—Douglas D. Watts
*Attorney, Agent, or Firm*—Salter & Michaelson

[57] ABSTRACT

A pocket knife includes a handle having a body portion and a blade pivotally attached to the body portion of the handle. The blade is movable between a closed position in which the blade is received within a groove of the handle and an open position in which the blade extends away from the handle and is exposed. The blade has a blade portion and a tang portion which is received within the groove of the handle when the blade is in its open position. A pin extends in a direction generally transverse with respect to the direction of the handle and blade, and is movable between a first position in which the pin engages the tang portion of blade for locking the blade in its open position, and a second position in which the pin is spaced away from the tang portion of the blade for allowing the blade to move to its closed position. A spring is provided for biasing the pin to its first position. Moreover, a sliding lock assembly is further provided for manually moving the pin to its second position from its biased first position.

10 Claims, 5 Drawing Sheets

POCKET KNIFE WITH LOCK

BACKGROUND OF THE INVENTION

This invention relates generally to knives, and more particularly to a pocket knife which is capable of being locked in an open position.

Pocket knives suitable for many purposes are well-known in the art. For example, U.S. Pat. No. 1,189,005 to Seely, U.S. Pat. No. 3,868,774 to Miori, U.S. Pat. No. 4,240,201 to Sawby et al., U.S. Pat. No. 4,274,200 to Coder, U.S. Pat. No. 4,451,982 to Collins, U.S. Pat. No. 4,502,221 to Pittman, U.S. Pat. No. 4,670,984 to Rickard, U.S. Pat. No. 4,837,932 to Elsener, U.S. Pat. No. 5,060,379 to Neely, U.S. Pat. No. 5,425,175 to Rogers, and U.S. Pat. No. 5,461,786 to Miller are representative of the available prior art.

Many of these patents disclose pocket knives which are capable of being locked in a blade open position. As disclosed in several of the aforementioned patents, there are many different mechanisms for locking the blade in an open position. For example, the patents to Sawby et al., Miller and Seely each disclose a variation of a "lock back" mechanism. This construction entails forming a notch on a tang of the blade which is engaged by a lug provided on a rocker mechanism located along the spine of the knife to lock the blade in an open position. A shortcoming of this type of mechanism is that excessive wear between the lug and the tang can cause the locking mechanism to fail thereby rendering the knife unsafe for use.

The patents to Neely and Collins each disclose another type of locking mechanism. As disclosed in these patents, the blade is provided with a tang that is engaged by a member for preventing the rotation of the blade to its closed position from its open position. For example, in Collins, a slidable bolt biased towards the tang is provided for locking the blade in its open position. A shortcoming with Collins's knife construction is that the axis of the bolt is generally parallel to that of the blade thereby lessening the strength of the locking mechanism. Neely's knife suffers from the same disadvantage as Collins's, and from the fact that the blade is unlocked by pulling the blade axially away from the handle which can be inadvertently achieved during a normal cutting motion of the knife.

In general, the present invention is directed to a pocket knife comprising a handle having a body portion with an elongate groove formed therein, and a blade pivotally attached to the body portion of the handle at one end of the body portion. The blade is movable between a closed position in which the blade is received within the groove of the handle and an open position in which the blade is extended away from the handle and exposed. The blade has a blade portion which extends away from the handle when the blade is in its open position and a tang portion which is received within the groove of the handle when the blade is in its open position. A pin extends in a direction generally transverse with respect to the direction of the handle and blade, and is movable between a first position in which the pin engages the tang portion of blade for locking the blade in its open position, and a second position in which the pin is spaced away from the tang portion of the blade for allowing the blade to move to its closed position. Suitable means is provided for biasing the pin to its first position. Moreover, moving means is further provided for manually moving the pin to its second position from its biased first position.

Accordingly, among the several objects of the present invention are the provision of a pocket knife having a sliding lock assembly which reliably maintains a blade of the knife in an open position; the provision of such a pocket knife which provides a stronger locking force on the blade of the knife than prior locking mechanisms; the provision of such a pocket knife which is sturdy in design and durable during use; the provision of such a pocket knife which has relatively few parts constituting its locking mechanism thereby making the knife easy to manufacture and assemble; the provision of such a pocket knife which is easy to operate; and the provision of such a pocket knife that has an attractive appearance.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
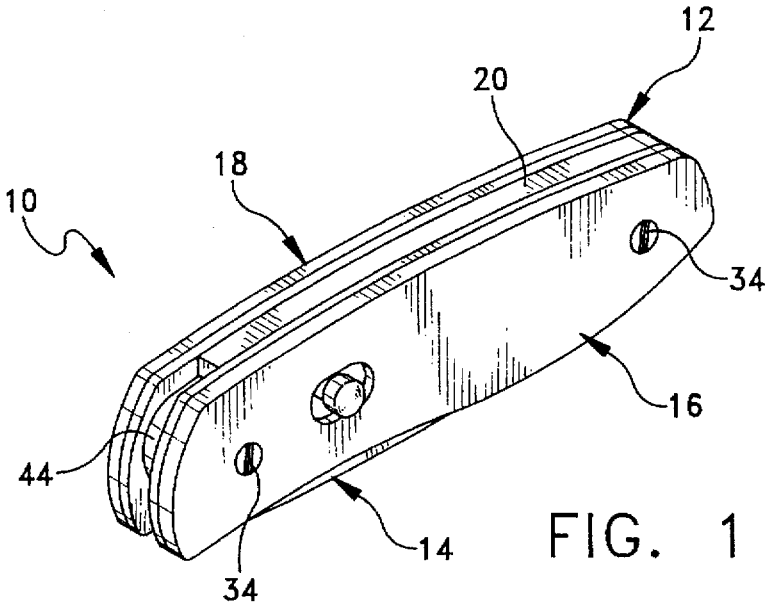
FIG. 1 is a perspective view of a pocket knife of the present invention, a blade of the knife being shown in a closed position in which it is received within a handle of the knife.
Figure 2:
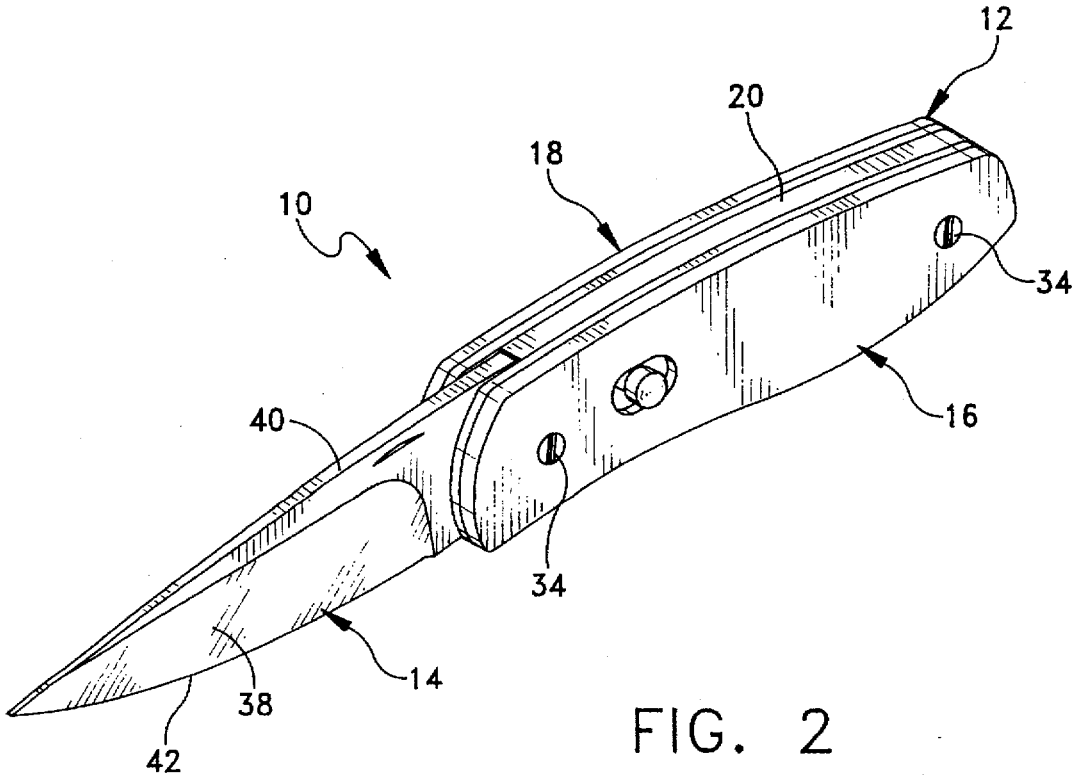
FIG. 2 is a perspective view of the pocket knife with the blade of the knife being shown in an open, operating position.

Referring now to the drawings, and more particularly to FIGS. 1 and 2, there is generally indicated at 10 a pocket knife of the present invention. The pocket knife 10 includes a handle, generally indicated at 12, and a blade, generally indicated at 14, which is pivotally attached to the handle at one end of the handle. FIG. 1 illustrates the blade 14 of the pocket knife 10 in a closed position in which the blade is received within the handle 12. FIG. 2 illustrates the blade 14 in an open or use position in which the pocket knife 10 can be used for any suitable purpose. It should be observed that the blade 14 of the pocket knife 10 of the present invention is capable of being locked in its open position so as to prevent the inadvertent movement of the blade to its closed position. The ability of the pocket knife 10 to securely lock the blade 14 in the open position makes the knife safer to use.

Figure 3:
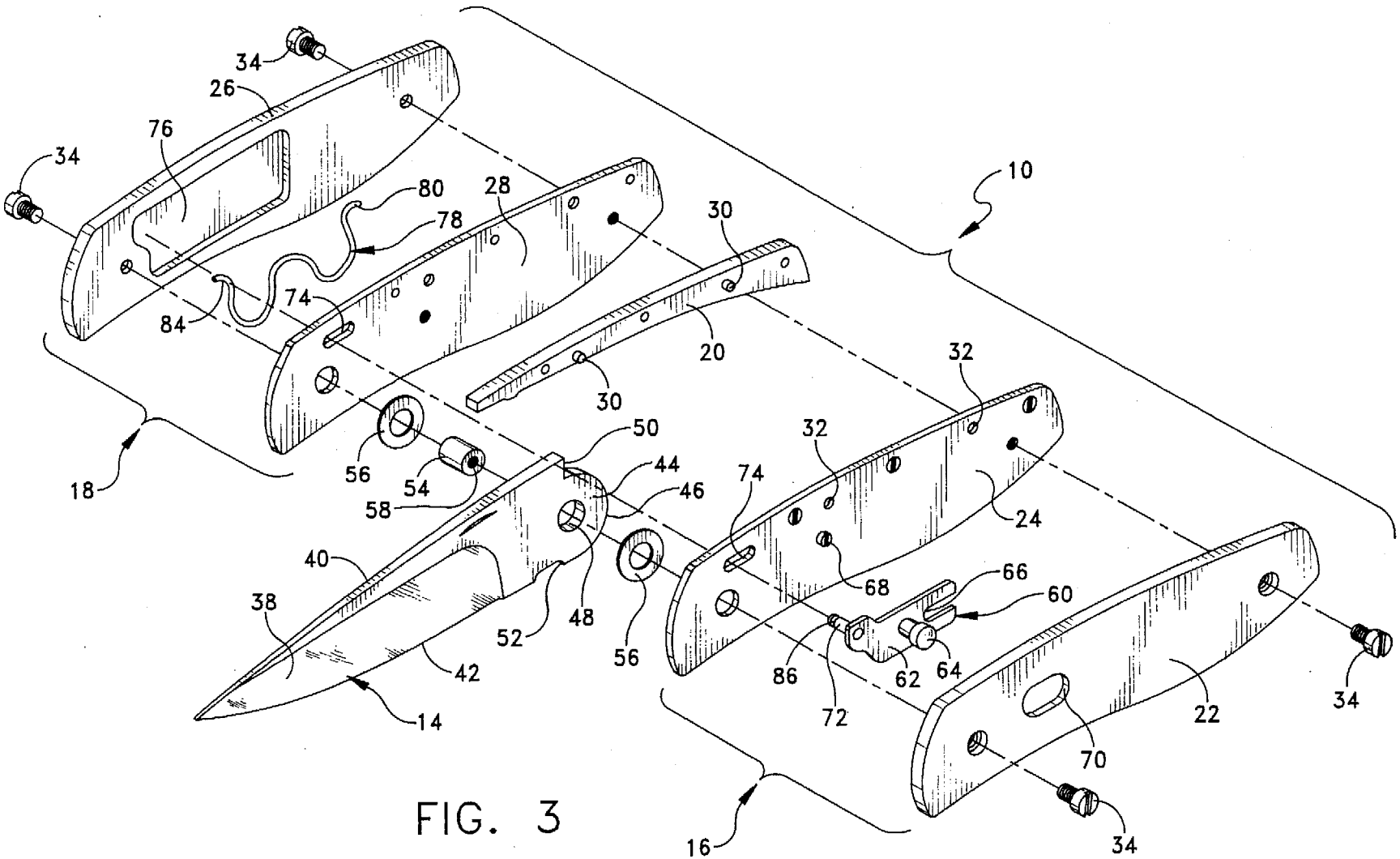
FIG. 3 is an exploded perspective view of the pocket knife.

Referring now to FIGS. 1–3, the handle 12 of the pocket knife 10 comprises several components, including a pair of oppositely positioned side wall sections, generally indicated at 16, 18, which are in parallel relation with respect to each other, and a spine section 20 which is adapted to join the side wall sections to one another along their upper long edges. As shown in FIG. 3, the side wall section 16 has an outer plate 22 and an inner liner 24 disposed interiorly with respect to the outer plate 22. Similarly, the other side wall section 18 has an outer plate 26 and an inner liner 28 also disposed interiorly of its outer plate 26.

When assembled, the spine section 20 is disposed between the liners 24, 28 of the side wall sections 16, 18, respectively, along the upper edge margins of the side wall sections wherein outwardly projecting detents 30 formed in the spine section are received in corresponding bores 32 formed in the liners for aligning the side wall sections with respect to one another and with the spine section. Suitable screw fasteners 34 are used to maintain the side wall sections 16, 18 and the spine section 20 in assembled relation. Preferably, the plates 22, 26 of the side wall sections 16, 18, respectively, are fabricated from Micarta® (by Westinghouse Electric & Manufacturing Company), although other suitable materials such as metal, plastic, wood, etc. can also be used. The liners 24, 28 of the side wall sections 16, 18, respectively, and the spine section 20 are preferably fabricated from steel or titanium since these components of the handle must be strong enough to bear the locking forces exerted thereon when locking the blade in its open position. This aspect of the present invention will be discussed in greater detail below.

The side wall sections 16, 18 and the spine section 20 create a blade receiving groove 36 (see FIG. 4) therebetween for receiving the blade 14 when it is moved to its closed position. Still referring to FIGS. 1–3, the blade 14 comprises an elongate blade portion 38 having an upper blunt edge 40 and a lower sharp edge 42, and a tang portion 44 which pivotally attaches the blade to the handle 12. The arrangement is such that the blade portion 38 extends away from the handle 12 when the blade 14 is in its open position and the tang portion 44 is received within the groove 36 when the blade is in either the open and closed position. Thus, it should be observed that the tang portion 44 is always completely concealed by the handle 12.

More specifically, the blade portion 38 is constructed in the well-known manner and is pivotally attached to the handle by the tang portion 44 so that the lower sharp edge 42 is received within the handle 12. The tang portion 44 is integrally-formed with the blade portion 38, and, as shown, is generally semi-circularly-shaped. The tang portion 44 has a semi-circularly-shaped peripheral edge 46 and a circular opening 48 is formed therein for attaching the blade 14 to the handle 12. One of the ends of the peripheral edge 46 of the tang portion 44 merges into an outwardly extending first shoulder 50. The other end of the peripheral edge 46 merges into an inwardly extending second shoulder 52. The first and second shoulders 50, 52 are generally perpendicular with respect to the direction of the peripheral edge 46 at their respective junctions; however, it should be observed as in FIG. 4 that the second shoulder 52 has a greater radius of curvature than the first shoulder 50.

As shown in FIG. 3, an annular shaft 54 fabricated from hard steel and a pair of annular shims each indicated at 56 attach the blade 14 to the handle 12. The shaft 54 is press-fit into the opening 48 formed in the tang portion 44 of the blade 14 so that the shaft functions as a pivot point for the blade. The annular shims 56 are received over respective ends of the shaft 54 in the manner illustrated in FIG. 3. The shaft 54 has a threaded axial bore 58 machined therethrough for threadably receiving the screw fasteners 34 which maintain the pocket knife 10 in assembled relation.

Figure 4:
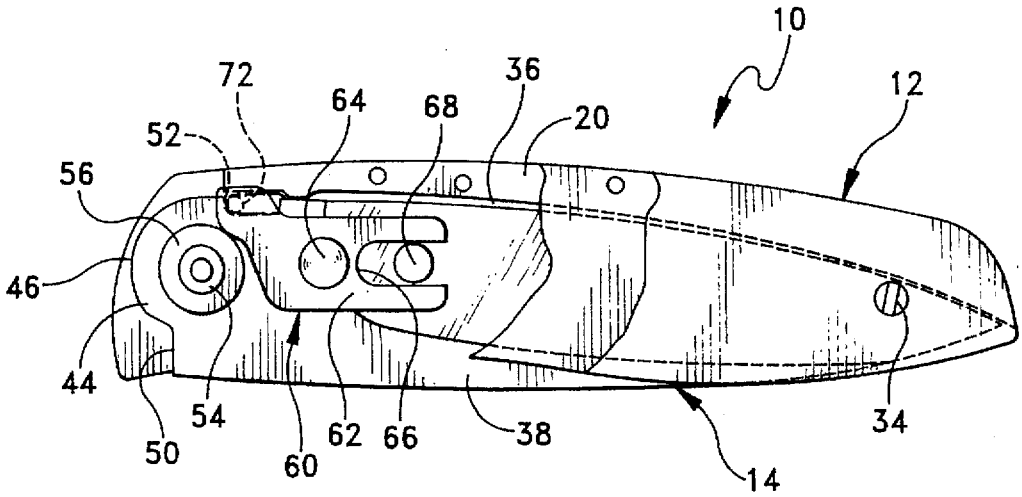
FIG. 4 is a front elevational view of the pocket knife with portions of the knife removed.
Figure 5:
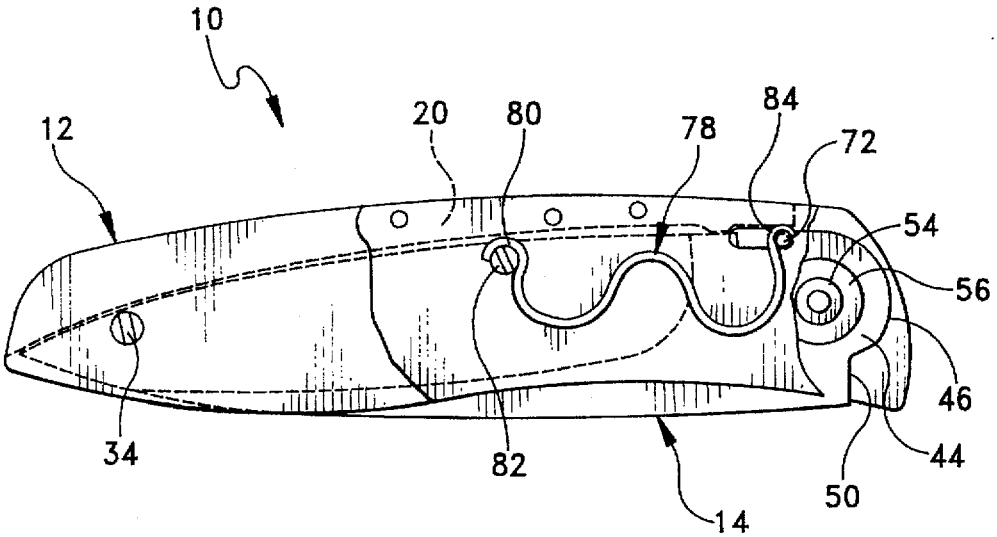
FIG. 5 is a rear elevational view of the pocket knife with portions of the knife removed.

Referring now to FIGS. 3–5, there is generally indicated at 60 a sliding lock assembly (otherwise sometimes referred to as "moving means") for locking the blade 14 in its open position. The sliding lock assembly 60 includes a planar body member 62 which extends along a plane generally parallel with respect to the plane of the side wall sections 16, 18 of the handle 12. Mounted on the body member 62 is an outwardly projecting arm member or knob 64 for slidably moving the body member 62 along an axis generally parallel to the axial direction of the handle 12. As shown best in FIG. 3, the body member 62 is disposed between the plate 22 and liner 24 of the side wall section 16. The body member 62 has a slot 66 formed therein which receives a detent 68 (e.g., a machine screw) suitably attached to the liner 24 for guiding the movement of the body member. The knob 64 extends through an elongated opening 70 formed in the plate 22 of the side wall section 16 so that it is accessible to the user of the pocket knife 10.

The sliding lock assembly 60 further includes a cylindrical pin 72 which is attached to the body member 62 (e.g., welded) and extends in a direction generally transverse with respect to the directions of the body member and handle 12. Specifically, the pin 72 has a cylindrically-shaped outer surface and a long axis that extends in a direction generally transverse with respect to the direction of the handle 12 and the blade 14. When assembled, the pin 72 extends through aligned elongated openings 74 formed in the liners 24, 28 of the side wall sections 16, 18, respectively, in which the free end of the pin is disposed generally in a large cavity 76 formed in the inwardly facing surface of plate 26 of side wall member 18. As shown in FIG. 4, the pin 72 of the sliding lock assembly 60 is adjacent the tang portion 44 of the blade 14, the purpose of this close positioning of the pin against the tang portion will become apparent as the description of the pocket knife 10 proceeds.

Figure 6:
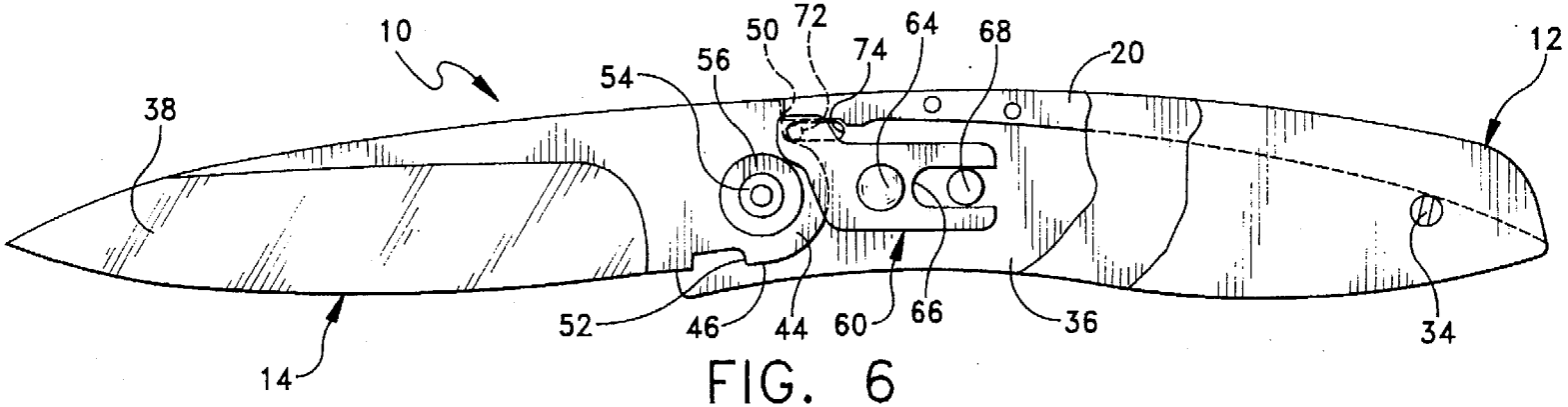
FIG. 6 is a front elevational view of the pocket knife with portions of the knife removed, the blade being illustrated in its open position.
Figure 7:
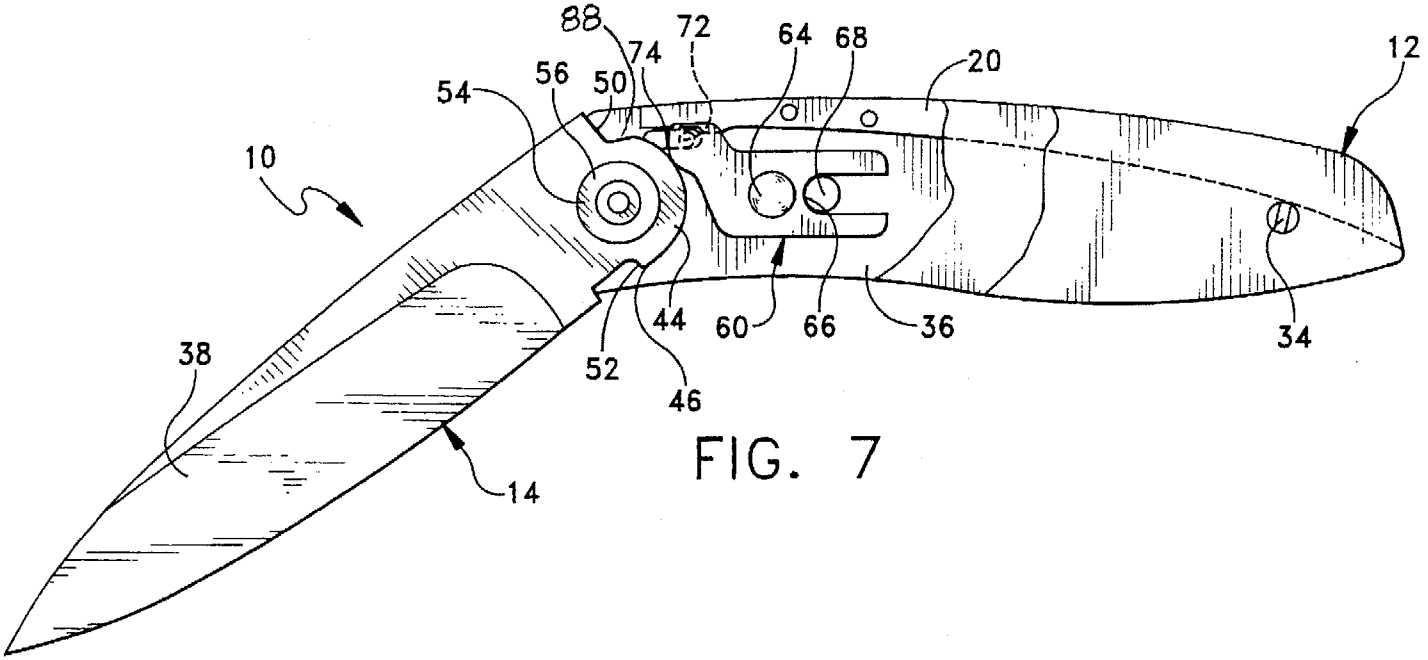
FIG. 7 is a front elevational view of the pocket knife similar to FIG. 6 with the blade of the knife being moved to its closed position.

Turning now to FIGS. 6 and 7, the sliding lock assembly 60 is movable in a direction parallel to the lengthwise direction of the handle 12 between a first position in which the cylindrically-shaped surface of the pin 72 of the sliding lock assembly engages the tang portion 44 of the blade 14 for locking the blade in its open position (FIG. 6), and a second position in which the pin of the sliding lock assembly is spaced away from the tang portion of the blade for allowing the blade to move to its closed position (FIG. 7). More specifically, when the sliding lock assembly 60 is in its first position for locking the blade 14 in its open position, the pin 72 is disposed in a recess created by the tang portion 44, first shoulder 50 and spine section 20. The arrangement is such that upon attempting to move the blade 14 to its closed position, the pin 72 engages the peripheral edge 46 of the tang portion 44 of the blade, the first shoulder 50, and the spine section 20 of the handle 12, and is wedged therebetween so that the pin interferes with the pivotal movement of the tang portion. Thus, it should be observed that the pin 72 of the sliding lock assembly 60 has a tendency of "wearing in" rather than wearing out since the more frequently the blade 14 is moved to its open position and locked therein by the pin, the further the pin becomes wedged between the peripheral edge 46 of the tang portion 44, the first shoulder 50 and the spine section 20 of the handle. Moreover, since the pin 72 engages three elements (i.e., the peripheral edge 46, first shoulder 50 and spine section 20) for locking the blade 14, this construction of pocket knife 10 provides a greater locking force than the prior art pocket knives described above.

A spring, generally indicated at 78, is further provided for biasing the pin 72 of the sliding lock assembly 60 to its first position. As illustrated in FIG. 5, one end 80 of the spring 78 engages a detent 82 (e.g., a machine screw) provided on the liner 28 of the side wall section 18. The other end 84 of the spring 78 engages the free end of the pin 72. More specifically, a circumferential groove 86 is formed in the pin 72 for receiving the end 84 of the spring 78 therein for ensuring that the spring maintains its engagement with the pin. Preferably, the spring 78 is fabricated from resilient material which is strong enough for biasing the sliding lock assembly 60 to its first position, but resilient enough so that when a person applies a force on the knob 64 in a direction away from the extended blade 14, the assembly is moved to its second position.

It should be observed that the peripheral edge 46 of the tang portion 44 defines a cam upon which the pin 72 rides when the sliding lock assembly 60 is moved to its second position. Moreover, referring briefly to FIG. 4 which illustrates the blade 14 in its closed position, the pin 72 is disposed between the peripheral edge 46 of the tang portion 44 and the second shoulder 52, and by moving the blade 14 to its open position, the second shoulder moves the pin 72 and the sliding lock assembly 60 to its second position for enabling the blade to open. It should be noted that the tang portion 44 of the blade 14 can be configured so that the blade is locked in its closed position and capable of being moved only upon moving the sliding lock assembly 60 to its second position and still fall within the scope of the present invention.

Another important feature of the tang portion construction of the blade 14 is that the shape of the peripheral edge 46 which defines the cam upon which the pin 72 rides further provides an opening and closing "assist" when opening and closing the blade of the knife 10. More specifically, as illustrated in FIGS. 4 and 5, the arrangement is such that, when closing the blade 14 of the knife 10, the pin 72 rides along the peripheral edge 46 until it rounds over corner at the junction of the peripheral edge and the second shoulder 52. This rounding over action actually assists in closing the blade 14 since the spring 78 is biasing the pin 72 engages the shoulder 52 so as to close the blade automatically. Turning now to FIGS. 6 and 7, when opening the blade 14, there is a transition at 88 in the curvature of the peripheral edge 46 which also takes advantage of the spring biased pin 72 acting on the tang portion 44 for assisting in opening the blade.

Figure 8:
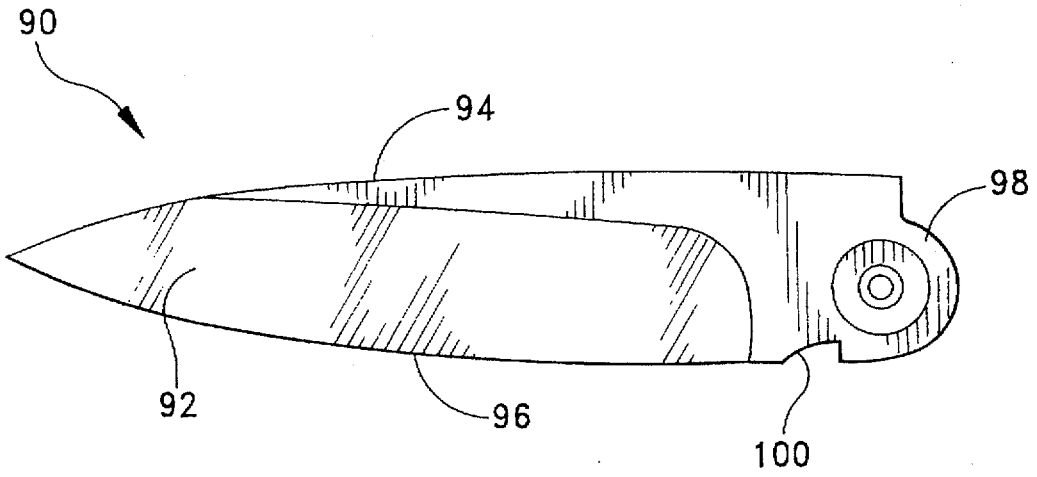
FIG. 8 is a front elevational view of a blade of another preferred embodiment.

FIG. 8 illustrates a blade 90 of another preferred embodiment. The blade 90 is similar to blade 14 in that it includes a blade portion 92 having an upper edge 94 and a lower edge 96, and a tang 98. However, the tang 98 has the addition of ramp 100. The purpose of ramp 100 is to allow an opening assist of the blade 90 when moving it from its closed to open position. Referring briefly to FIG. 4, when the knob 64 is moved to the second position, the pin 72 pushes ramp 100 causing partial opening of the knife. This is desirable so that the knife can be opened with one hand.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A pocket knife comprising:

a handle having a body portion with an elongate groove formed therein;

a blade pivotally attached to the body portion of the handle at one end of the body portion, said blade being movable between a closed position in which the blade is received within the groove of the handle and an open position in which the blade is extended away from the handle and exposed, said blade having a blade portion which extends away from the handle when the blade is in its open position and a tang portion which is substantially received within the groove of the handle when the blade is in its open position, said tang portion having a peripheral edge defining a cam;

a pin having a cylindrically-shaped outer surface and a long axis extending in a direction generally transverse with respect to the direction of the handle and blade, said pin being movable between a first position in which the outer surface of the pin engages the tang portion of blade for locking the blade in its open position, and a second position in which the pin is spaced away from the tang portion of the blade for allowing the blade to move to its closed position, the outer surface of said pin riding upon the cam of the tang portion upon moving the pin to its second position and moving the blade to its open position;

biasing means for biasing the pin to its first position; and moving means for manually moving the pin to its second position from its biased first position.

2. A pocket knife as set forth in claim 2, said peripheral edge of the tang portion being generally semicircular in shape.

3. A pocket knife comprising:

a handle having a body portion with an elongate groove formed therein;

a blade pivotally attached to the body portion of the handle at one end of the body portion, said blade being movable between a closed position in which the blade received within the groove of the handle and an open position in which the blade is extended away from the handle and exposed, said blade having a blade portion which extends away from the handle when the blade is in its open position and a tang portion which is received within the groove of the handle when the blade is in its open position, said tang portion having a peripheral edge defining a cam, said peripheral edge of the tang portion being generally semi-circular in shade;

a pin extending in a direction generally transverse with respect to the direction of the handle and blade, said pin being movable between a first position in which the pin engages the tang portion of blade for locking the blade in its open position, and a second position in which the pin is spaced away from the tang portion of the blade for allowing the blade to move to its closed position, said pin riding on the cam of the tang portion when moving the blade to its open position;

biasing means for biasing the pin to its first position; and moving means for manually moving the pin to its second position from its biased first position, wherein said peripheral edge of the tang portion having a shoulder formed therein at the junction of the peripheral edge and the blade portion, said shoulder being generally perpendicular with said peripheral edge at its junction and engaging said pin when the pin is in its first position.

4. A pocket knife as set forth in claim 1, said body portion of the handle having a pair of oppositely positioned side wall sections which are in parallel relation with respect to each other and a spine section which joins the pair of side wall sections along long edges thereof, said pair of side wall sections and said spine section defining said groove formed in the body portion which receives said blade portion of the blade upon moving the blade to its closed position.

5. A pocket knife as set forth in claim 4, said pin being disposed between a recess created by said tang portion of the blade and said spine section of the handle when the pin is in its first position and the blade is in its open position for preventing the movement of the blade from its open position to its closed position.

6. A pocket knife as set forth in claim 4, said moving means comprising a planar body member extending along a plane generally parallel to the plane of the side wall sections of the handle, said body member having one end of said pin attached thereto, and an outwardly projecting arm member extending from the body member, said arm member being adapted to be moved by hand for manually moving the pin between its first and second positions.

7. A pocket knife as set forth in claim 6, said arm member extending through an opening formed in one of said side wall sections of the handle.

8. A pocket knife as set forth in claim 6, said biasing means comprising a spring having one of its ends resiliently engaging the handle and its other end resiliently engaging one of said pin and said moving means for biasing the pin in its first position.

9. A pocket knife as set forth in claim 1, said biasing means comprising a spring having one of its ends resiliently engaging the handle and its other end resiliently engaging one of said pin and said moving means for biasing the pin in its first position.

10. A pocket knife as set forth in claim 1, said peripheral edge of the tang portion having a shoulder formed therein at the junction of the peripheral edge and the blade portion, said shoulder being generally perpendicular with said peripheral edge at its junction, said pin engaging the shoulder of the tang portion when the pin is in its first position.

* * * * *

UNITED STATES PATENT AND TRADEMARK OFFICE

CERTIFICATE OF CORRECTION

PATENT NO : 5,737,841

DATED : April 14, 1998

INVENTOR(S) : McHenry, et al.

It is certified that error appears in the above-identified patent and that said Letters Patent are hereby corrected as shown below:

| | |
|---|---|
| Col. 6, Line 24 | Change "A pocket knife as set forth in claim 2 . . ." to read --A pocket knife as set forth in claim 1 . . .-- |

Signed and Sealed this

Fifteenth Day of May, 2001

*Attest:*

Nicholas P. Godici

NICHOLAS P. GODICI

*Attesting Officer*

*Acting Director of the United States Patent and Trademark Office*